US006170299B1

(12) United States Patent
Apollonio

(10) Patent No.: US 6,170,299 B1
(45) Date of Patent: Jan. 9, 2001

(54) METHOD AND APPARATUS FOR TRANSFERRING A LOOP FROM A SELECTED NEEDLE TO AN ADJACENT NEEDLE FOR CREATING A DECORATIVE OPEN-WORK PATTERN

(75) Inventor: Francesco Gavagnin Apollonio, Hickory, NC (US)

(73) Assignee: Edelweiss Manufacturing Co., Inc., Hickory, NC (US)

( * ) Notice: Under 35 U.S.C. 154(b), the term of this patent shall be extended for 0 days.

(21) Appl. No.: 09/613,120

(22) Filed: Jul. 10, 2000

Related U.S. Application Data

(63) Continuation of application No. 09/241,415, filed on Feb. 2, 1999, now Pat. No. 6,089,045.

(51) Int. Cl.[7] ..... D04B 9/02

(52) U.S. Cl. ..... 66/13; 66/215

(58) Field of Search ..... 66/8, 13, 30, 37, 66/46, 51, 58, 95, 116, 120, 173, 215, 121, 123

(56) References Cited

U.S. PATENT DOCUMENTS

| | | | | |
|---|---|---|---|---|
| 2,060,020 | * | 11/1936 | Boaler | 66/113 |
| 2,076,896 | * | 4/1937 | Jones | 66/113 |
| 2,188,125 | * | 1/1940 | Wigley | 66/113 |
| 2,292,940 | * | 8/1942 | Holmes et al. | 66/113 |
| 2,780,082 | * | 2/1957 | Zeruneith | 66/113 |
| 2,953,914 | * | 9/1960 | Zeruneith | 66/113 |
| 2,997,865 | * | 8/1961 | Philp | 66/113 |
| 3,084,528 | * | 4/1963 | Philip | 66/113 |
| 3,110,167 | * | 11/1963 | Parthum | 66/113 |
| 3,225,569 | * | 12/1965 | Luchi | 66/120 |
| 3,470,715 | * | 10/1969 | Parthum | 66/120 |
| 3,508,420 | * | 4/1970 | Parthum et al. | 66/120 |
| 3,584,481 | * | 6/1971 | Hayashi | 66/120 |
| 3,609,998 | * | 10/1971 | Mutze et al. | 66/113 |
| 3,613,399 | * | 10/1971 | Fecker | 66/113 |
| 3,636,730 | * | 1/1972 | Fecker | 66/95 |
| 3,800,560 | * | 4/1974 | Hanney et al. | 66/14 |
| 3,838,583 | * | 10/1974 | Rumi et al. | 66/95 |
| 4,005,589 | * | 2/1977 | Uhlir | 66/95 |
| 4,612,786 | * | 9/1986 | Perotti | 66/121 |
| 6,085,554 | * | 7/2000 | Apollonio | 66/123 |
| 6,089,045 | * | 7/2000 | Apollonio | 66/13 |

FOREIGN PATENT DOCUMENTS

| | | | | |
|---|---|---|---|---|
| 446670 | * | 4/1936 | (GB) | 66/113 |
| 1246449 | * | 10/1989 | (JP) | 66/113 |

* cited by examiner

*Primary Examiner*—Danny Worrell
(74) *Attorney, Agent, or Firm*—Adams, Schwartz & Evans, P.A.

(57) ABSTRACT

A method for creating an opening in tubular knitted fabric articles, including the steps of providing a knitting machine having a plurality of needles mounted in axial needle slots in a needle cylinder, the needles having a hook formed in a top end of a needle shank and a latch pivotally mounted on the needle shank below the hook for opening and closing the hook. A deflector is provided for deflecting a loop of yarn being formed by a needle into the vertical plane of an adjacent needle. A needle is selected from which a loop is to be transferred. The loop on the selected needle is enlarged by deflecting the loop out of the vertical plane of the selected needle laterally into the vertical plane of an adjacent needle while the adjacent needle is in a lowered, non-interfering position relative to the deflected loop. The adjacent needle is moved upwardly into the enlarged loop, and the selected needle is thereafter removed from the deflected loop, whereby the loop is transferred to the adjacent needle and an opening is present in the fabric in the position of the selected needle. An apparatus for practicing the method is also disclosed and claimed.

11 Claims, 9 Drawing Sheets

METHOD AND APPARATUS FOR TRANSFERRING A LOOP FROM A SELECTED NEEDLE TO AN ADJACENT NEEDLE FOR CREATING A DECORATIVE OPEN-WORK PATTERN

This application is a continuation of application Ser. No. 09/241,415 U.S. Pat. No. 6,089,045, filed on Feb. 2, 1999, and titled METHOD AND APPARATUS FOR TRANSFERRING A LOOP FROM A SELECTED NEEDLE TO AN ADJACENT NEEDLE FOR CREATING A DECORATIVE OPEN-WORK PATTERN. The present invention generally relates to circular knitting machines capable of manufacturing apparel, including hosiery and like articles. More particularly, the invention relates to a method and apparatus for transferring a loop or loop from a selected needle to an adjacent needle by enlarging the loop on the selected needle and then inserting the other needle through the enlarged loop before the selected needle releases the loop. The term loop is used below to define the segment of yarn being manipulated by the needles, but the term "stitch" can be used interchangeably.

TECHNICAL FIELD AND BACKGROUND OF THE INVENTION

Circular knitting machines knit together multiple strands of yarn into a tubular fabric, hosiery blank or other structure. The hosiery blank is then finished according to conventional processes to create finished hosiery articles, such as socks, hose and stockings. Such machines include a plurality of needles positioned in axial slots formed in an exterior surface of a rotatable needle cylinder. Each needle includes a shank having opposed ends. A hook is formed in a top end of the needle shank and a butt is formed in the bottom end of the needle shank. A plurality of sinkers are mounted in a sinker ring positioned on a top end of the needle cylinder such that the sinkers are alternately positioned between the needles. Circular knitting machines also include a feeder mechanism that delivers yarn onto the passing needles. The yarn forms a loop or loop around each needle.

Hosiery articles with decorative patterns formed by open-work in the fabric created by transferred knitting loops is old and conventional. The space not occupied by the transferred loop creates a hole in the fabric, and the pattern of holes in the fabric collectively create the desired decorative effect. Heretofore such designs have been limited to relatively coarse gauge fabrics due to the difficulty in transferring very small loops between fine gauge needles. Thus, there is a need for a knitting machine and method which permits the creation of decorative open-work patterns in fine gauge knitted fabric, including fine gauge fashion hosiery, such as tights, pantyhose and similar articles.

For example, U.S. Pat. No. 3,838,583 to Rumi et al. discloses apparatus which modifies a circular knitting machine so that it can create openings with transfer loops. The Rumi apparatus includes a dial plate eccentrically positioned over and internal to a needle cylinder and a planetary gear eccentrically positioned over and external to the needle cylinder. The upper surface of the dial plate is provided with a plurality of internal punches slidable in a radial direction, and the upper surface of the planetary gear is provided with a plurality of external punches slidable in a radial direction. The internal punches are inclined suitably in the direction opposite of the direction of rotation. Devices are provided to control the axial movement of the internal and external punches and cam means are provided to raise the needles to the level of the punches. Finally, a plurality of movable sinkers are positioned on the needle cylinder and each partially surround one of the needles. The strands of yarn loop around the needles and extend over the sinkers.

In operation, the selectors raise a specified needle or group of needles past their normal working position. The loop on the needle catches on a needle shoulder which raises the loop above the sinker surrounding the needle. The sinker, which has an end hook, then advances and its hook enters the loop causing the loop to enlarge. Immediately afterwards, either of the two punches enter the loop by passing adjacent to an undercut in the needle. The needle is then returned to its normal position leaving the loop on the punch. The punch transports the loop to the intended needle which is raised up through the loop. That needle continues to rise until the loop is removed from the punch and then returns to its normal position. If the internal punch is used, the loop is transferred to the needle preceding the needle from which the loop was taken. If the external punch is used, the loop is transferred to the needle following the needle from which the loop was taken.

The Rumi apparatus, like other existing apparatus used for transferring loops, first removes the loop from the selected needle and then transfers that loop to the following needle. This practice can only be used effectively on circular knitting machines operating with one hundred and twenty (120) needles or less because the small size of the needles and loops on most circular knitting machines operating more than one hundred and twenty (120) needles prevents the apparatus from reliably transferring the loop. A missed transfer creates a defect which results in a less than first-quality product. The missed transfer problem is naturally exacerbated when the diameter of the needle cylinder is decreased and/or the number of needles being operated is increased.

Consequently, transfer loops cannot be reliably made on prior art fine gauge circular knitting machines. A need, therefore, exists for a method and apparatus for effectively transferring loops from a selected needle to an adjacent needle without dropping a loop and without creating other defects in hosiery articles manufactured on a circular knitting machine capable of creating fine gauge articles.

SUMMARY OF THE INVENTION

Therefore, it is an object of the invention to provide a method and apparatus for reliably transferring loops to create hosiery having a pattern of small openings which collectively create a decorative appearance to the fabric. Unlike existing methods and apparatus, the present invention enables open-work patterns to be formed in very fine gauge hosiery created on, for example, circular knitting machines operating 120 or more needles positioned on a needle cylinder having a diameter of 3.5 inches or less. The invention is capable of being used on any gauge machines with as little as 1 mm spacing between needles.

Accordingly, a principal object of the present invention is to provide a method for virtually error-free transfer of a loop from a selected needle to a following needle on a circular knitting machine, including but not limited to a fine gauge circular hosiery knitting machine, such as one having 120 or more needles positioned on a needle cylinder having a diameter of 3.5 inches or less.

A further object of the invention is to provide a method of or transferring a loop from a selected needle to a following needle by securing the loop on the following needle before the selected needle releases the loop.

A further and more particular object of the invention is to provide a method and apparatus for transferring a loop from a selected needle to a following needle by widening the loop on the selected needle, inserting the following needle through the widened loop, and only then removing the selected needle from the widened loop thereby causing the selected needle to release the loop.

Another object of the invention is to provide an apparatus for performing the transfer loop operation.

Another object of the invention is to provide enlarging means and cam means for performing the transfer loop operation.

Another object of the invention is to provide means for adapting a common circular knitting machine by inclusion of the invented apparatus to minimize manufacturing cost, to guarantee reliable operation, and to avoid the necessity of requiring operator re-training.

The method according to the invention involves transferring a loop from a selected needle to a following needle during the operation of a circular knitting machine. As used herein, a selected needle is a needle from which the transfer loop is removed, and a following needle is an adjacent needle onto which the transfer loop is placed. It is contemplated by the present invention that the following needle may be either the needle immediately preceding the selected needle with respect to the direction of needle cylinder rotation or the needle immediately succeeding the selected needle with respect to the direction of needle cylinder rotation.

To perform the transfer loop operation, the loop on the selected needle is enlarged or widened. Once the loop on the selected needle is sufficiently enlarged, the following needle is inserted through the enlarged loop such that the loop may then be secured around the following needle. Finally, the selected needle is removed from the enlarged loop thereby causing the selected needle to release the loop. As a result, the loop is completely transferred from the selected needle to the following needle and a controlled perforation is formed in the hosiery article. A pattern of openings may be formed in the hosiery article by selecting needles in accordance with a pre-determined set of instructions.

The apparatus for performing the invented method includes means for enlarging the loop on the selected needle and cam means for controlling the movement of the needles to effectuate the transfer of the selected loop from the selected needle to the following needle.

Each needle has a latch positioned below the hook. The latch pivots between a hook closed position in which the distal end of the latch abuts the distal end of the hook and a hook open position in which the latch abuts the shank of the needle and is distally disposed with respect to the hook. The hook and latch of each needle are aligned in a radially outwardly manner with respect to the needle cylinder. The butts formed in the bottom end of each needle extend radially outwardly beyond the circumference of the needle cylinder. The bottom end of each needle abuts a top end of a selector shank which is also positioned in the axial slots of the needle cylinder. The selector shanks each have teeth extending radially outwardly beyond the circumference of the needle cylinder.

An actuator engages the teeth on the selector shanks and vertically moves particular needles according to a pre-programmed set of instructions. Typically, the actuator is controlled by a computer which repeatedly selects a particular group of needles to create a desired pattern of openings in the hosiery article being formed.

In a preferred embodiment, the loop-enlarging means is a deflector integrally formed with and extending laterally from the shank of each needle at a location below the latch and the cam means includes an upper cam and a lower cam positioned adjacent the exterior surface of the needle cylinder. The deflectors are generally delta shaped, sharing a common edge with the needle shank and increasing in width from top to bottom. A distal region of each deflector extends beyond the plane of the following needle. Finally, the deflectors initially extend radially outwardly, but they then curve radially inwardly toward the longitudinal axis of the needle cylinder. A loop-retaining means, such as a catch, is preferably formed in the distal region of each deflector.

The lower cam is positioned proximate to the bottom end of the needle cylinder. The lower cam has a gradually upwardly sloping contact surface for guiding the teeth of the selector shanks below the selected needles. Only the selected needles raised by the actuator encounter the contact surface of the lower cam. The lower cam raises the selected needles such that the butts of those needles are properly positioned with respect to the upper cam.

The upper cam preferably includes three members. The first member of the upper cam is positioned above the lower cam and is off-set from the contact surface of the lower cam in the direction of needle cylinder rotation. The second member of the upper cam is positioned above the first member of the upper cam and is generally triangular in shape. The second member of the upper cam has an upwardly sloping upper contact surface for guiding the butts of the selected needles upwardly thereby forcing the selected needles to further rise.

For simplicity of understanding, the following discussion of the operation of the invented apparatus describes one complete rotation of the needle cylinder in which only one needle is selected. There are at least three zones encountered by the needles during each complete revolution of the needle cylinder. The first zone is the loop feed zone in which the feeder mechanism delivers yarn onto the hooks of the needles. The last zone is the loop release zone. Between the loop feed zone and loop release zone is at least one loop transfer zone. Multiple loop transfer zones can be used to either create more complex patterns or transfer loops more than once. As the needles enter a loop transfer zone, the needles are positioned below their respective sinkers and the latches on the needles are in the hook closed position.

In a loop transfer zone, the actuator selects a needle by engaging a tooth on the selector shank below that needle. The actuator raises the selector shank and the selected needle to a position that aligns a tooth on the selector shank with the contact surface of the upper cam. Consequently, the selected needle rises as the selector tooth travels upwardly along the contact surface of the upper cam. This upward movement of the selected needle causes the loop on that needle to slide downwardly past the latch thereby moving the latch down to the hook open position. During this upward movement of the selected needle, the following needle (and all non-selected needles) engage the lower cam which initially maintains the hooks of the non-selected needles below the sinkers.

As the butt of the selected needle travels upwardly along the upper cam, the loop on that needle continues to slide downwardly where it encounters a deflector formed on the shank of the needle. The loop widens as it slides down the deflector. When the butt of the selected needle reaches the apex of the upper cam, the loop is enlarged laterally into the plane of the following needle. The hook at the distal end of the deflector catches the loop which prevents it from sliding down past the deflector.

While the butt of the selected needle is traveling along the upper cam, the butt of the following needle engages the lower cam which causes the following needle to rise. The following needle is raised to the extent that the loop on that needle travels far enough down the shank of the needle to move the latch downwardly to the hook open position. The loop, however, does not move past the latch. A downwardly sloping lower contact surface of the upper cam then forces the following needle to move back down below its sinker but the latch on that needle remains down in the hook open position.

Naturally, more than one loop transfer zone can be used to accelerate the loop transfer process and to create more complex open-work patterns in the fabric being formed.

After the needles exit the loop transfer zones, they enter the loop release zone. In the loop release zone all of the needles are first raised to a height sufficient to cause the loops on the needles to slide past the latches and are then lowered down below the sinkers. Consequently, all of the needles release their respective loop. The needles then leave the loop release zone and again rotate past the feeder mechanism where yarns are again placed on all of the needles and the process is repeated.

These and further and other objects and features of the invention are apparent in the disclosure, which includes the above and ongoing written specification, with the claims and the drawings.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 11:
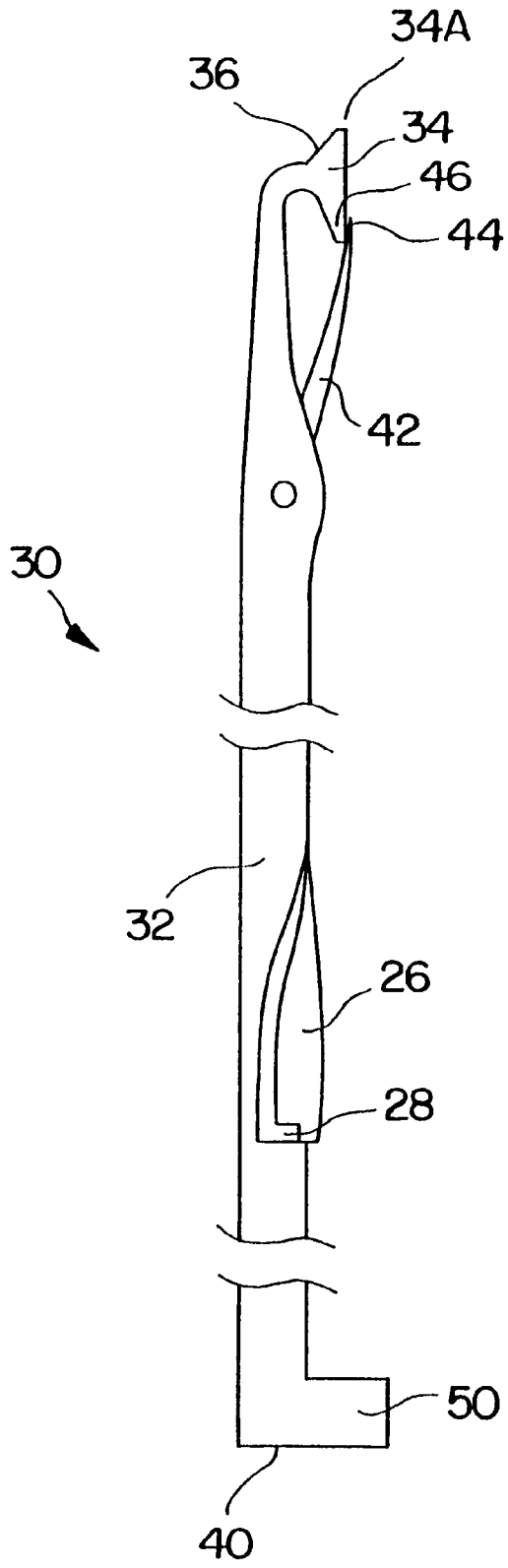
FIG. 11 is a overall view of a needle used in connection with the method and apparatus according to an embodiment of the invention.

Referring now specifically to the drawings, a segment of a knitting machine with needles according to the present invention is illustrated in FIGS. 1–7, and shown generally at reference numeral 10. The knitting machine 10 may be a modification of a lace pantyhose machine, or other knitting machine suitable for forming tubular knit fabrics with open-work areas. Such machines 10 typically have a hollow needle cylinder 12 mounted in a housing (not shown). The cylinder 12 is rotated by conventional means about its longitudinal axis during fabric formation. A plurality of axial slots 16 are formed in an exterior surface 18 of the needle cylinder 12, and a plurality of needles 30 are slidably mounted in the slots 16 for reciprocating up-and-down movement under the control of mechanical, electromechanical or electronic patterning and fabric formation devices. A needle 30 suitable for use with the machine 10 is shown generally in FIG. 11 and described in connection with FIGS. 1–7.

A plurality of resilient rings (not shown) are positioned around the needles 30 and the needle cylinder 12 to maintain the position of the needles 30 in the slots 16. Due to the rotation of the needle cylinder 12, the needles 30 revolve about the vertical axis of the needle cylinder 12. A plurality of sinkers 20 are positioned on a top end 22 of the needle cylinder 12.

Figure 1:
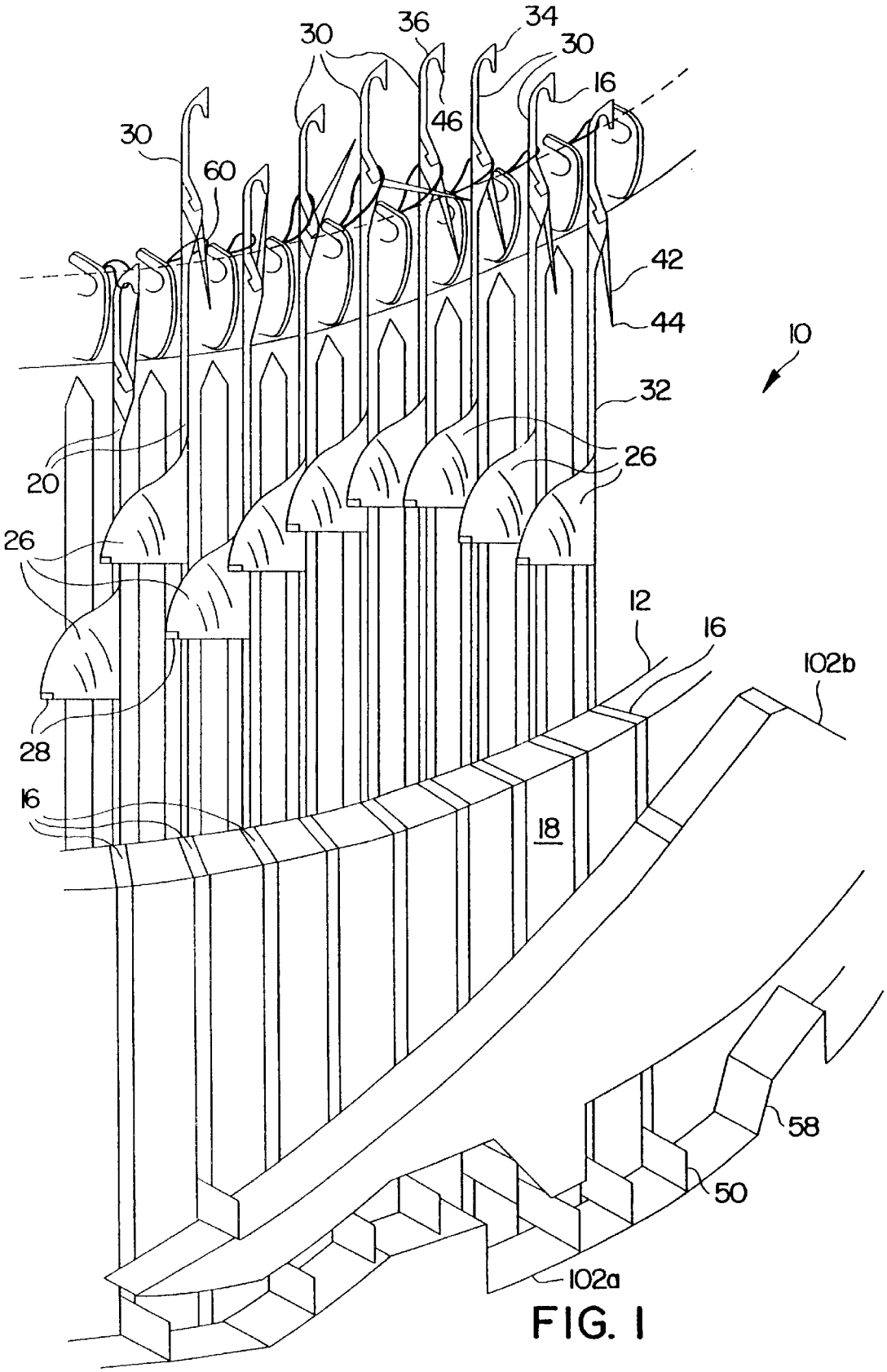
FIG. 1 is an isometric view of the needle cylinder of a lace pantyhose machine showing two selected needles approaching the second part of the upper cam according to the invention.
Figure 2:
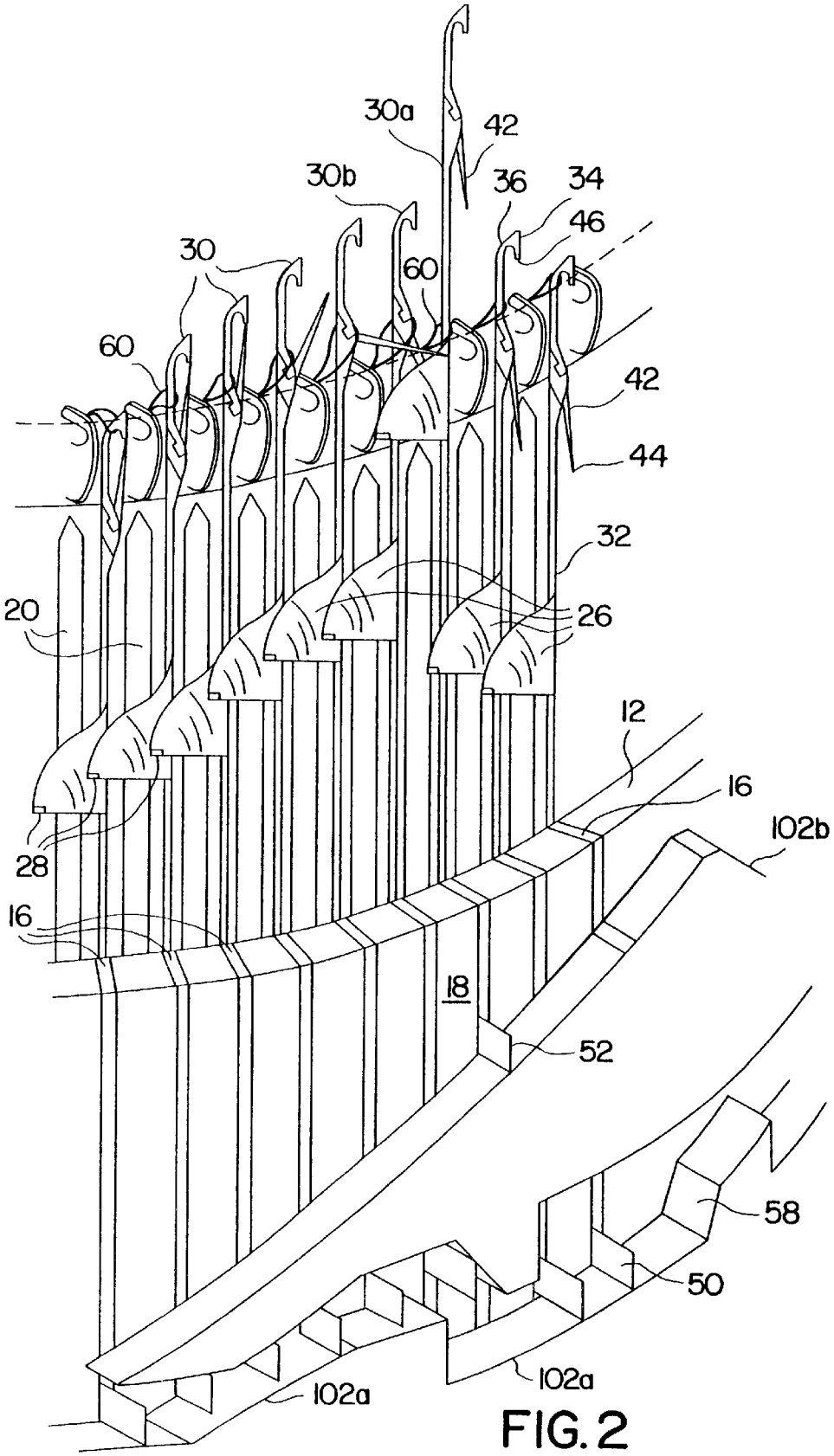
FIG. 2 is an isometric view of the needle cylinder showing two selected needles engaging the upper contact surface of the first part of the upper cam.
Figure 3:
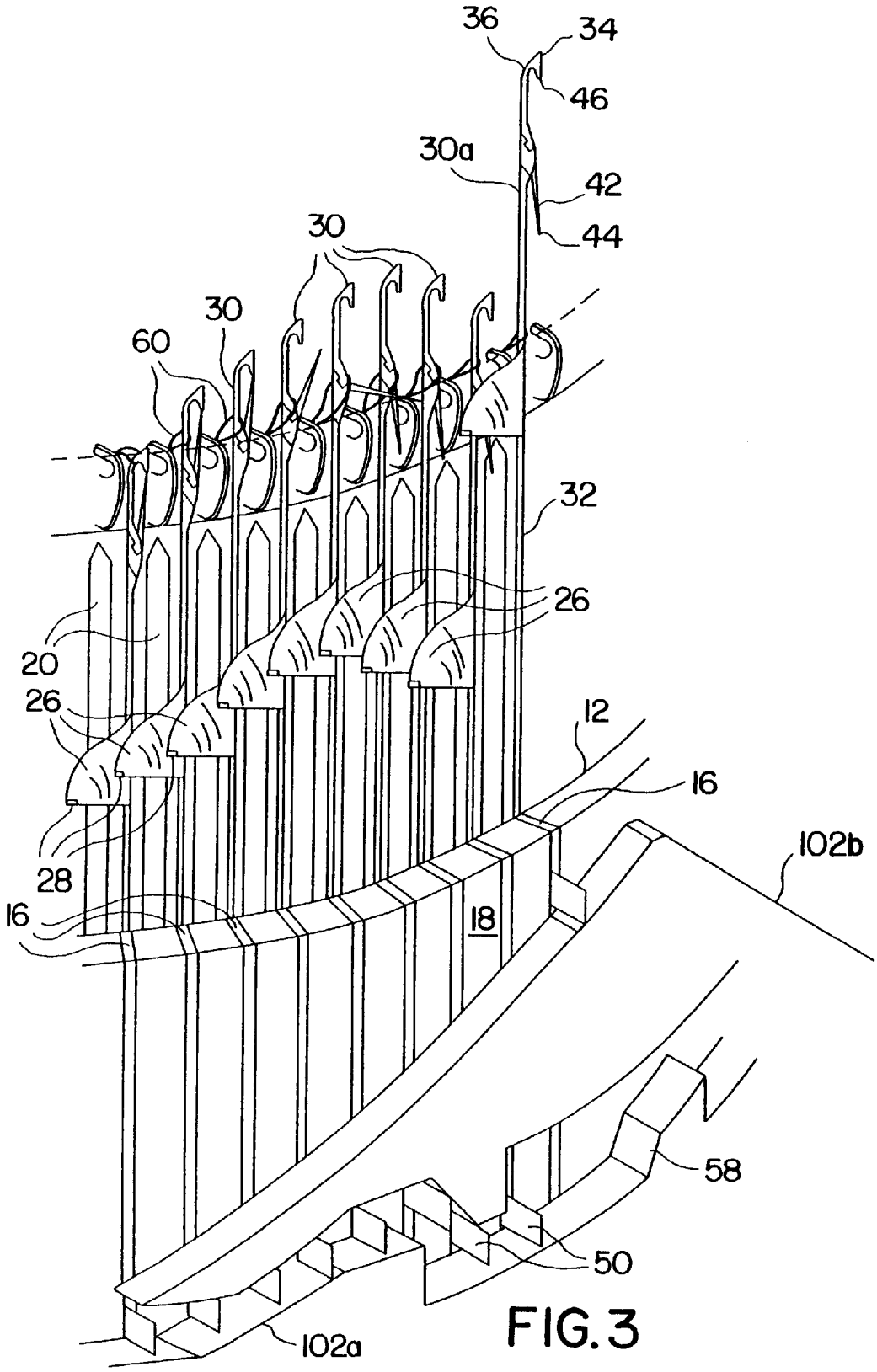
FIG. 3 is an isometric view of the needle cylinder showing two selected needles approaching the apex of the upper contact surface of the first part of the upper cam.
Figure 4:
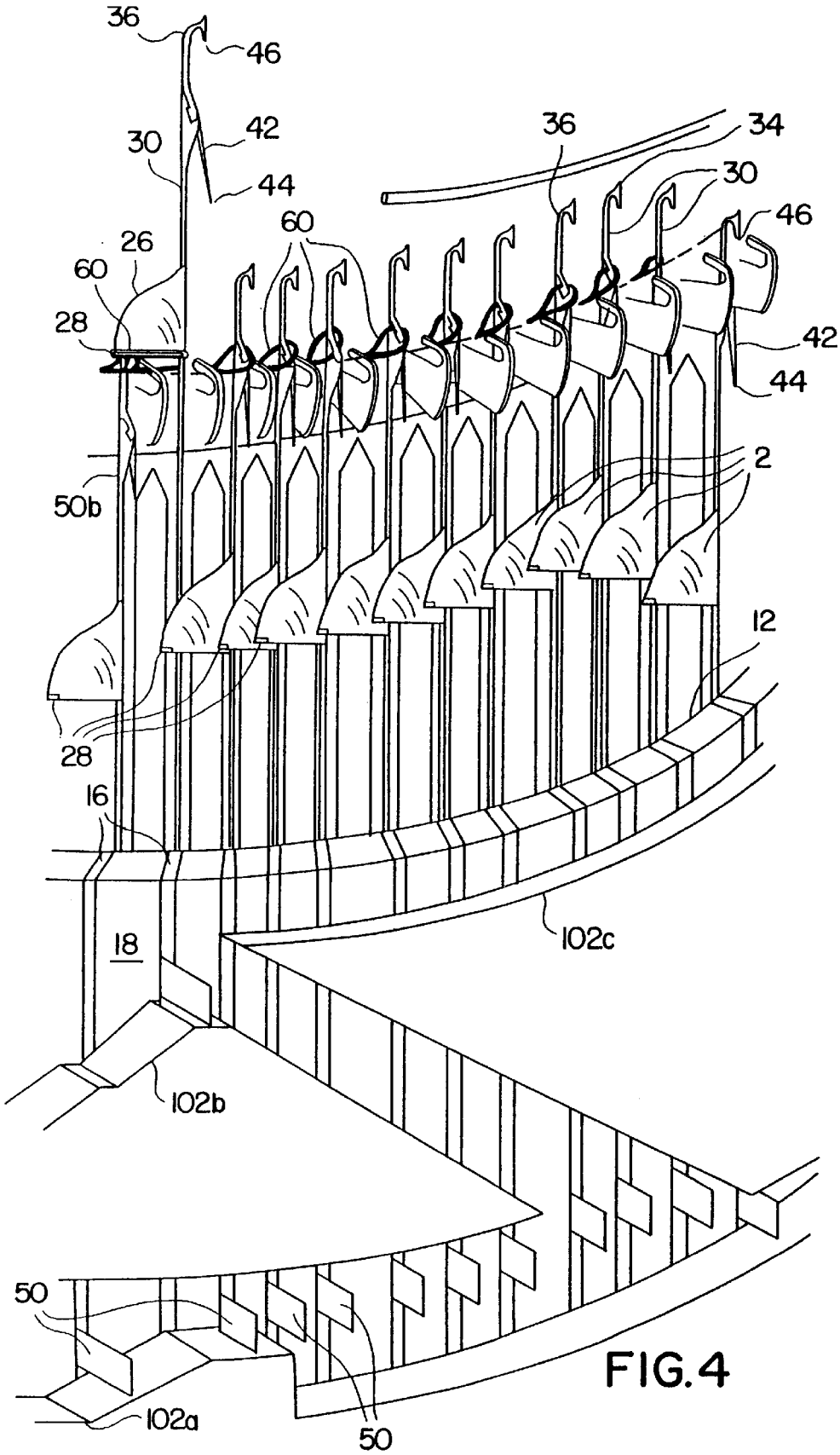
FIG. 4 is an isometric view of the needle cylinder showing two selected needles engaging the contact surface of the third part of the upper cam.
Figure 5:
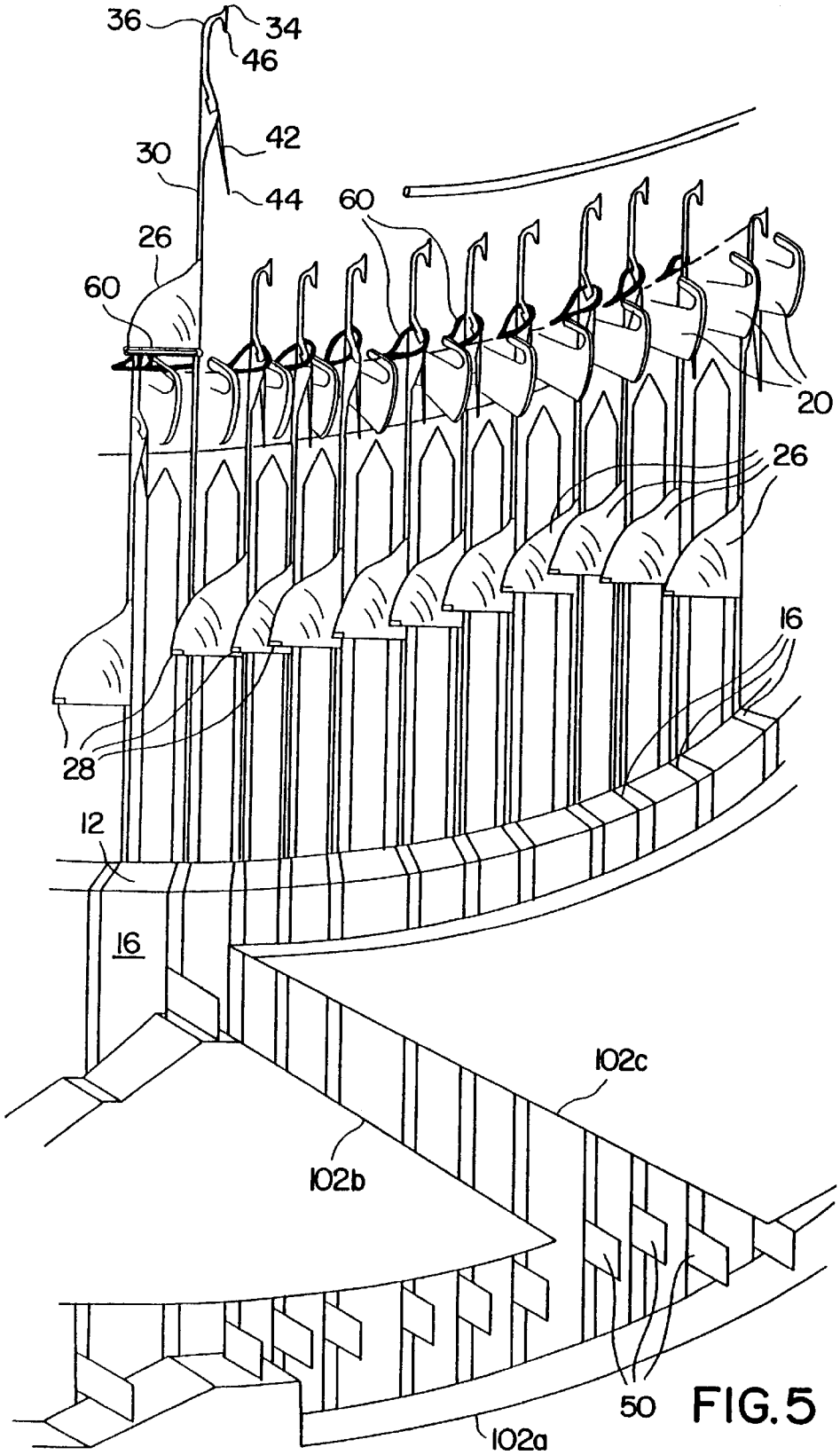
FIG. 5 is an isometric view corresponding to FIG. 1 showing the relative position of the selected needles with respect to the remaining needles.
Figure 6:
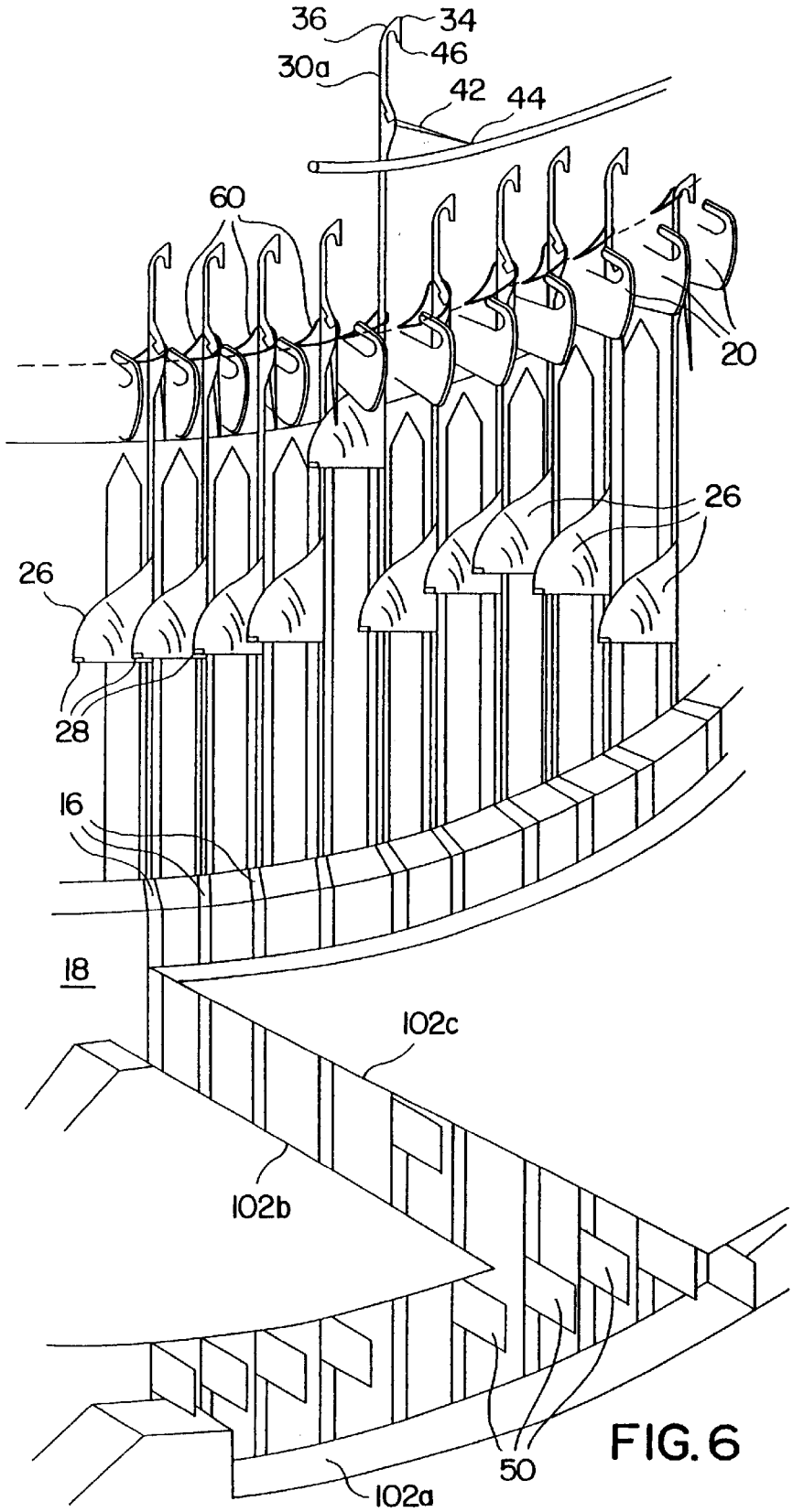
FIG. 6 is an isometric view corresponding to FIG. 2 showing the relative position of the selected needles with respect to the remaining needles.
Figure 7:
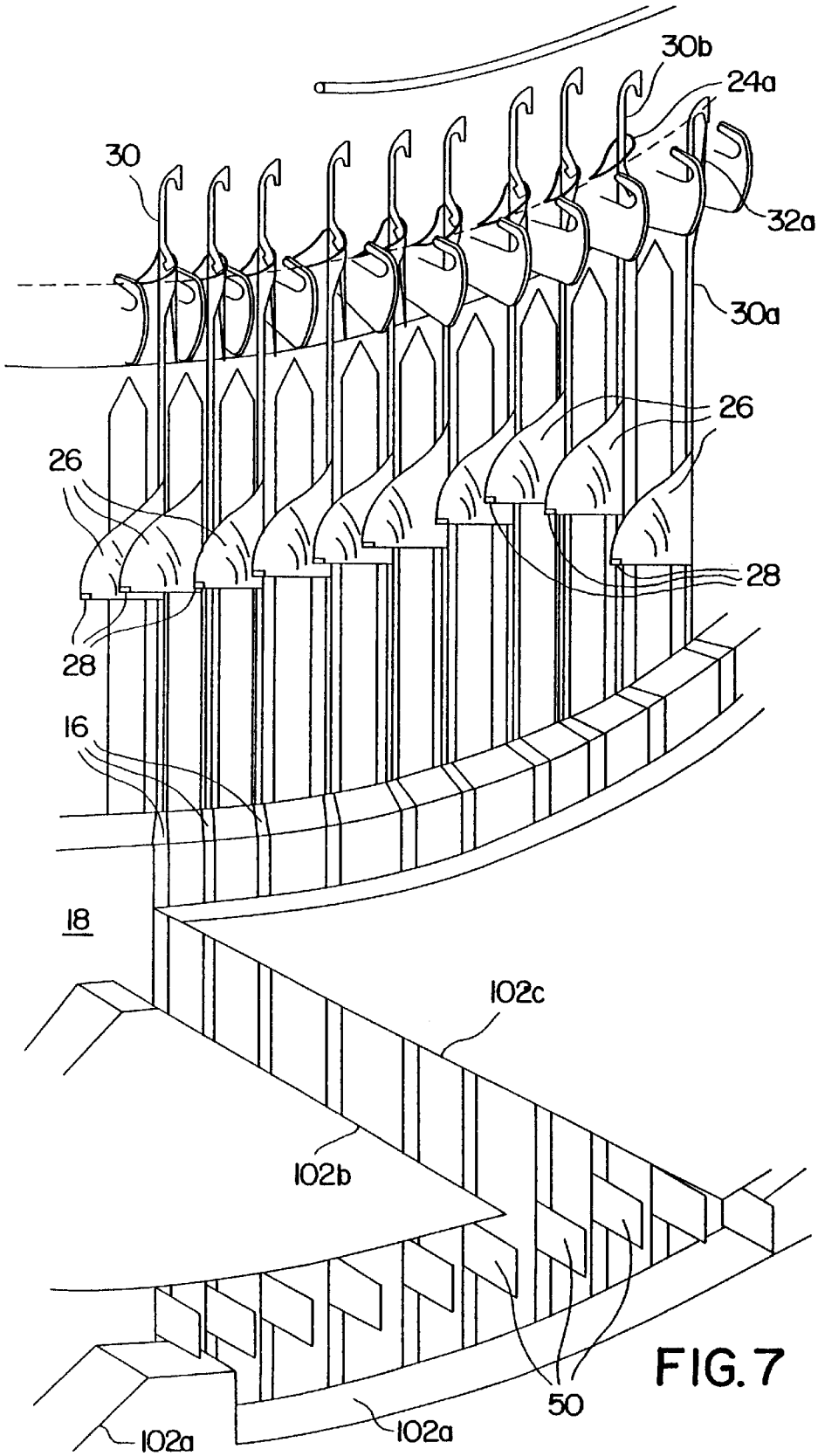
FIG. 7 is an isometric view corresponding to FIG. 3 showing the relative position of the selected needles with respect to the remaining needles.
Figure 8:
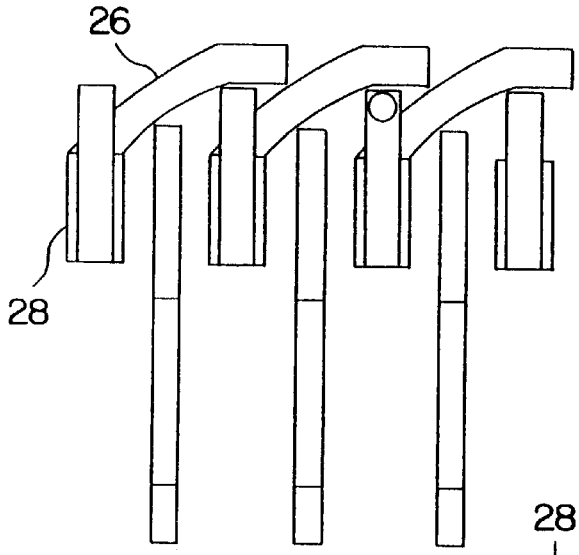
FIG. 8 is an isometric view corresponding to FIG. 4 showing the relative position of the selected needles with respect to the remaining needles.
Figure 9:
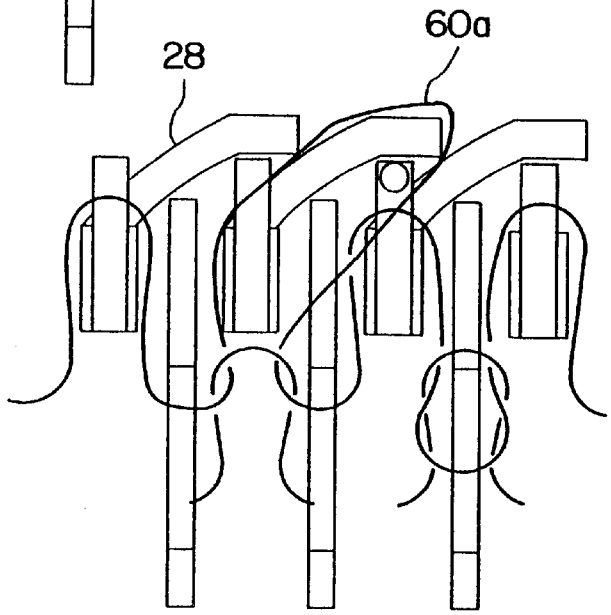
FIG. 9 is an isometric view of a preferred embodiment of the needles having deflectors.
Figure 10:
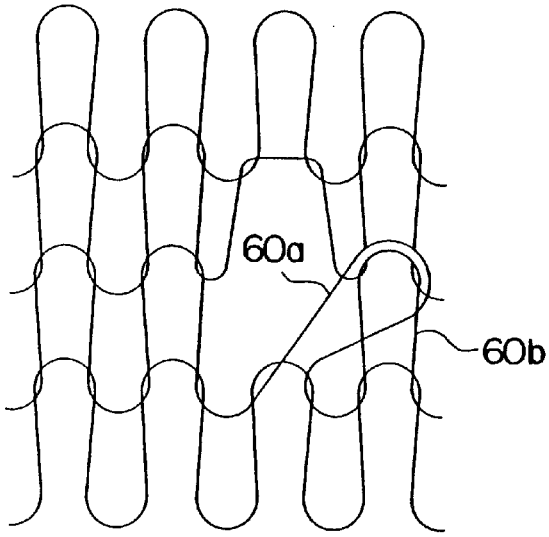
FIG. 10 is an isometric view of a preferred embodiment of the needles having pivoting arms.

Each needle 30 has an elongate shank 32 having opposed ends. A hook 34 is formed in a top end 36 of the needle shank 32, and a butt 50 is formed in the bottom end 40 of the needle shank 32. Below the hook 34, a latch 42, pivotally attached to the needle shank 32, opens and closes the hook 34. The latch 42 pivots between a hook closed position in which the distal end 44 of the latch 42 abuts the distal end 46 of the hook 34 and a hook open position in which the latch 42 abuts the needle shank 32 and is distally disposed with respect to the hook 34. The hook 34 and latch 42 are radially aligned with respect to the needle cylinder 12 with the open side of the needle 30 facing outwardly. In a loop transfer zone, an actuator selects a needle 30*a* in a conventional manner and raises the selected needle 30*a* to a position that aligns needle butt 50 with a contact surface of the a lower cam 102*a*. Consequently, the selected needle 30*a* rises as the butt travels upwardly along the contact surface of the lower cam 102*a*. This upward movement of the selected needle 30*a* causes the loop 60 on the selected needle 30*a* to slide downwardly past the latch 42 thereby moving the latch 42 down to the hook open position, as shown in FIG. 2. The lower cam 102*a* raises the selected needle to a position in which the butt 50 of the selected needle 30*a* is aligned with an upper contact surface of the upper cam 102*b*. During this upward movement of the selected needle 30*a*, the following needle 30*b* (and all non-selected needles) engage the lower cam 102*a* which initially maintains the hooks of the non-selected needles below the sinkers 20.

As the butt 50 of the selected needle 30*a* travels upwardly along the upper cam 102*b*, the loop 60 continues to slide downwardly where it encounters the deflector 26 carried on the shank 32 of each needle 30. The yarn slides down the curved surface of the deflector 26, which causes the loop to widen. When the butt 50 of the selected needle 30*a* reaches the apex of the upper cam 102*b*, the loop is enlarged sufficiently to reside with the plane of vertical movement of the following needle 30*b*. The catch 28 at the distal end of the deflector 26 catches the loop which prevents it from sliding off of the lower end of the deflector 26 and onto the lower portion of the needle shank 32. While the butt 50 of the selected needle 30*a* is traveling along the upper surface of cam 102*b*, the butt 50 of the following needle 30*b* engages a first section of the upper cam 102*b* which causes the following needle 30*b* to rise. The following needle 30*b* is raised to the extent that the loop on that needle travels far enough down the shank 32 of the needle 30*b* to move the latch 42 downwardly to the hook open position. The loop, however, does not move past the latch 42. The upper cam 102*b* then forces the following needle 30*b* to move back down below its sinker 20 but the latch 42 on the needle 30*b* remains down in the hook open position.

The cam 102*a* again raises the following needle 30*b*. Because the apex of the cam 102*a* corresponds to the apex of the cam 102*b*, the following needle 30*b* rises up through the enlarged loop positioned around the bottom end of the deflector 26 of the selected needle 30*a*. The hook 34 of the following needle 30*b* is positioned above the loop, but the distal end of the latch 42 of the following needle 30*b* remains below the loop. The following needle 30*b* remains in this position until its butt 50 encounters the contact surface of cam 102*c*. The second cam 102*b* and third cam 102*c* are spaced apart to provide sufficient time for the following needle 30*b* to rise up through the enlarged loop. The cam 102*c* is generally shaped like a trapezoid inverted with respect to the cam 102*a*. The cam 102*c* has a downwardly sloping contact surface proximate the cams 102*a* and 102*b*. See FIGS. 4 and 5.

The butt 50 of the selected needle 30*a* engages the downwardly sloping contact surface of the cam 102*c* causing the selected needle 30*a* to move downwardly. The loop 60 slides upwardly on the shank 32 of the selected needle 30*a*. The loop 60 forces the latch 42 to move upwardly to the hook closed position which prevents the loop from returning into the hook 34 of the selected needle 30*a*. When the hook of the selected needle 30*a* moves down below its sinker 20, the loop is released. The cam 102*c* forces the selected needle 30*a* down below the sinker 20 before it forces the following needle 30*b* to do the same. The loop 60 is caught in the hook 34 of the following needle 30*b* which is still positioned above its sinker 20 and which still has its latch 42 in the hook open position. Finally, the cam 102*c* forces all of the needles 30 to move down below their respective sinkers 20. Naturally, more than one loop transfer zone can be used to accelerate the loop transfer process and to create more complex perforation patterns in the hosiery article being formed.

After the needles exit the loop transfer zones, they enter the loop release zone. In the loop release zone all of the needles 30 are first raised to a height sufficient to cause the loops 60 on the needles to slide past the latches 42 and are then lowered down below the sinkers 20. Consequently, all of the needles 30 release their respective loop 60. The needles then leave the loop release zone and again rotate past the feeder mechanism where loops are again placed on all of the needles and the process is repeated.

An apparatus and method for producing fine gauge open-work tubular knitted fabrics is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A method for creating an opening in tubular knitted fabric articles, comprising the steps of:

(a) providing a knitting machine having a plurality of needles mounted in axial needle slots in a needle cylinder positioned between alternating sinkers, said needles having a hook formed in a top end of a needle shank and a latch pivotally mounted on the needle shank below the hook for opening and closing the hook, and including deflector means for deflecting a loop of yarn being formed by a needle into the vertical plane of an adjacent needle;

(b) selecting a needle from which a loop is to be transferred;

(c) enlarging the loop on the selected needle by deflecting the loop out of the vertical plane of the selected needle laterally into the vertical plane of an adjacent needle while the adjacent needle is in a lowered, non-interfering position relative to the deflected loop and relative to an immediately adjacent sinker;

(d) moving a the adjacent needle upwardly into the enlarged loop; and (e) removing the selected needle from the deflected loop, whereby the loop is transferred to the adjacent needle and an opening is present in the fabric in the position of the selected needle.

2. A method according to claim 1, wherein method comprises the steps of:

(a) creating a predetermined open-work pattern representing a desired pattern of openings in a tubular knitted fabric; and (b) carrying out the steps of claim 1 according to the predetermined pattern thereby creating a tubular knitted fabric having an open-work pattern corresponding to the predetermined pattern.

3. A method according to claim 1 or 2, wherein the machine comprises a fine gauge tubular knitting machine suitable for knitting pantyhose.

4. A method according to claim 3 wherein the step of enlarging the loop on the selected needle comprises the step of moving the selected needle relative to the loop of yarn from the direction of the top of the needle to the bottom of the needle and past a progressively sloping loop contact surface.

5. A method according to claim 4, wherein said knitting machine is a fine gauge hosiery machine having a knitting cylinder diameter of 3.5 inches or less mounted in a housing.

6. A method according to claim 4, wherein said progressively sloping contact surface comprises a deflector integrally formed on the shank of the needle and extending laterally outwardly from the needle shank towards an adjacent needle.

7. An apparatus for creating an opening in knitted fabric articles, comprising:

(a) a tubular knitting machine having a plurality of needles mounted in axial needle slots in a needle cylinder, said needles having a hook formed in a top end of a needle shank and a latch pivotally mounted on the needle shank below the hook for opening and closing the hook, and including deflector means for deflecting a loop of yarn being formed by a needle into the vertical plane of an adjacent needle;

(b) needle selection means for selecting a needle from which a loop is to be transferred;

(c) loop enlarging means cooperating with the selected needle for deflecting the loop out of the vertical plane of the selected needle laterally into the vertical plane of an adjacent needle while the adjacent needle is in a lowered, non-interfering position relative to the deflected loop and an immediately adjacent sinker;

(d) needle insertion means for moving an adjacent needle upwardly for insertion into the enlarged loop; and (e) selected needle removal means for removing the selected needle from the deflected loop after the loop has been transferred to the adjacent needle, whereby the loop is transferred to the adjacent needle and an opening is present in the fabric in the position of the selected needle.

8. An apparatus according to claim 7, and including:

(a) pattern means for storing a predetermined open-work pattern representing a desired pattern of openings in a tubular knitted fabric and selecting needles and transferring loops according to the predetermined pattern to thereby creating a tubular knitted fabric having an open-work pattern corresponding to the predetermined pattern.

9. An apparatus according to claim 7 or 8, wherein the machine comprises a fine gauge tubular knitting machine suitable for knitting pantyhose.

10. An apparatus according to claim 9, wherein the selected needle includes a progressively sloping loop contact surface.

11. An apparatus according to claim 10, wherein said progressively sloping contact surface comprises a deflector integrally formed on the shank of the needle and extending laterally outwardly from the needle shank towards an adjacent needle.

* * * * *

UNITED STATES PATENT AND TRADEMARK OFFICE

CERTIFICATE OF CORRECTION

PATENT NO. : 6,170,299
DATED : January 9, 2001
INVENTOR(S) : Apollonio, F.

It is certified that error appears in the above-identified patent and that said Letters Patent is hereby corrected as shown below:

In Claim 1(d), line 21, delete "a the" and insert "an".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*